United States Patent [19]

Luschnig et al.

[11] Patent Number: 4,699,398

[45] Date of Patent: Oct. 13, 1987

[54] DEVICE FOR FACILITATING LONGITUDINAL ADJUSTMENT OF SKI BINDING PARTS

[75] Inventors: Franz Luschnig, Traiskirchen; Hubert Wuerthner, Hainburg/D.; Herbert Kaineder, Hundsheim; Fritz Leichtfried, Traiskirchen, all of Austria

[73] Assignee: TMC Corporation, Baar, Switzerland

[21] Appl. No.: 510,458

[22] Filed: Jul. 1, 1983

[30] Foreign Application Priority Data

Jul. 5, 1982 [AT] Austria ..... 2583/82
Oct. 8, 1982 [AT] Austria ..... 3737/82

[51] Int. Cl.[4] ..... A63C 9/00
[52] U.S. Cl. ..... 280/633
[58] Field of Search ..... 280/633, 636, 607; 441/70

[56] References Cited

U.S. PATENT DOCUMENTS

| | | | |
|---|---|---|---|
| 3,913,931 | 10/1975 | Kratky | 280/633 |
| 3,989,274 | 11/1976 | Weigl | 280/633 |
| 4,157,193 | 6/1979 | Beyl | 280/633 |
| 4,589,674 | 5/1986 | Krob et al. | 280/633 |

FOREIGN PATENT DOCUMENTS

| | | | |
|---|---|---|---|
| 276180 | 10/1969 | Austria | 280/633 |
| 338674 | 9/1977 | Austria | 280/633 |
| 2342378 | 2/1975 | Fed. Rep. of Germany | 280/633 |
| 3015478 | 11/1980 | Fed. Rep. of Germany | 280/633 |
| 2340749 | 9/1977 | France | 280/633 |
| 2451756 | 10/1980 | France | 280/633 |
| 556674 | 12/1974 | Switzerland | 280/633 |

*Primary Examiner*—David M. Mitchell
*Attorney, Agent, or Firm*—Flynn, Thiel, Boutell & Tanis

[57] ABSTRACT

A device for effecting longitudinal adjustment of ski binding parts includes a guide rail which is adapted to be mounted on a ski and has a longitudinally extending serrated edge, a guide plate slidably supported on the guide rail for longitudinal movement, a locking member having teeth thereon and supported on the guide plate for movement between first and second positions in which the teeth respectively engage and are free of engagement with the serrated edge, a resilient arrangement which yieldably urges the locking member toward its first position, and an arrangement cooperable with the locking member for releasably holding it in its second position.

23 Claims, 16 Drawing Figures

DEVICE FOR FACILITATING LONGITUDINAL ADJUSTMENT OF SKI BINDING PARTS

FIELD OF THE INVENTION

The invention relates to a device for effecting longitudinal adjustment of ski binding parts and, more particularly, to such a device which includes a guide rail which can be secured on a ski, which is provided with two lateral guide bars, and which has two serrated edges which are arranged between the lateral guide bars and extend longitudinally of the device, with which edges is associated a locking member which is biased by one end of a compression spring which has its other end supported on a guide plate which is movably supported on the guide rail, and which has, viewed from the side, approximately an upwardly open U-shape, the web which connects the two legs thereof having locking teeth thereon.

BACKGROUND OF THE INVENTION

A device of the above-mentioned type is described in Austrian Patent No. 338 674. In this conventional device, a locking is effected by means of an eccentric arranged in a bearing having a precisely machined bore and a considerable axial length in order to prevent, even after long use of the device, an inclined position of the eccentric shaft. This measure is expensive and requires much work. A further disadvantage of this conventional device is that the locking member is moved into engagement with the serrated edge against the force of the springs, which makes it possible in the case of breakage of the eccentric for the locking member to be lifted automatically out of engagement with the serrated edge.

Another device for facilitating longitudinal adjustment of ski binding parts includes a guide rail which can be secured on a ski, is provided with two lateral guide bars, and has two serrated edges which are arranged between the guide bars and extend in the longitudinal direction of the device, wherein the serrated edges have associated with them a locking member which is biased by at least one helical spring toward the serrated edges, the other end of the helical spring being supported on a bent portion of a guide plate which is movably supported on the guide rail, the ski binding part which is to be adjusted being mounted on the guide plate.

In order to hold the locking member in this device, which has not been disclosed in a printed publication, in a position in which it does not engage the serrated edges, the locking member is provided with lateral shoulders which are held by frictional contact on downward projections of the guide plate, the surfaces on the guide plate which face the shoulders extending, at least over a portion of their length, inclined with respect to a reference normal to the guide plate. Furthermore, in this embodiment, and aside from the guide plate, a special slide plate is also needed which is constructed in one piece with the locking member. All this makes this device somewhat complicated in its design and its manufacture.

It is furthermore suggested in French Patent No. 2 451 756 to equip a heel down-holding arrangement with a device for effecting longitudinal adjustment. In this device, the guide rail is provided with a row of holes which two projections on a locking member can engage in the locked position of the device, the locking member being pressed toward the guide rail by the urging of a helical spring. The locking member is supported, when the ski boot is not inserted, on a downwardly projecting wall of the housing of the heel down-holding arrangement. It is constantly coupled with an approximately U-shaped wire, the web of which extends transversely with respect to the guide rail and is disposed in a recess in the heel holder.

Should the heel down-holding arrangement need to be adjusted along the guide rail, then by means of a special tool in the form of a screwdriver having two grooves which are arranged in the narrow side surfaces of the blade and are directed against the axis of the screwdriver, the wire and thus the locking member are lifted by rotating the screwdriver 90°. The heel down-holding arrangement can thereafter be moved along the guide rail.

When the desired position of the heel down-holding arrangement is reached, the screwdriver is rotated back 90° and thereafter pulled out of engagement with the wire. Through this, and due to the helical spring, the projections on the locking member engage the holes in the guide rail.

This embodiment has the disadvantage that, on the one hand, the heel down-holding arrangement must be specially constructed and that, on the other hand, its adjustment requires a special tool. The solution which is disclosed in the mentioned reference can therefore not be used in general, namely, in connection with a heel holder of any desired type.

A similar embodiment of a heel down-holding arrangement is illustrated in German Offenlegungsschrift No. 30 15 478. In this embodiment, the guide rail is provided with rows of holes which can be engaged by downward projections on a locking member which is pressed toward the guide rail by helical springs. This is brought about by inclined surfaces on the locking member which, when the ski boot is not inserted, rest on corresponding inclined surfaces of the housing of the heel down-holding arrangement.

If the engagement of the locking member and guide rail is to be released, then the locking member is lifted by means of a shoulder which projects rearwardly from the housing of the heel down-holding arrangement and extends parallel to the guide rail in the locking position of the locking member, which causes the projections on the locking member to leave the holes in the guide rail and the heel down-holding arrangement to be able to be moved along the guide rail.

This construction also has the disadvantage that the heel down-holding arrangement must be specially constructed and that, during the adjusting operation, the shoulder of the locking member must always be held, which makes a one-handed adjustment impossible.

Furthermore, it has already been suggested to secure the heel down-holding arrangement on a guide plate which is adjustable along a guide rail provided with a serrated edge and which can be secured by means of a locking member (see for example German Offenlegungsschrift No. 23 42 378). In this design, the engagement of the locking member, which at its end is wedge-shaped, occurs vertically downwardly into the serrated portion, which has upwardly projecting teeth. Furthermore, the engagement takes place under the urging of a compression spring, and thus through a frictional connection, so that during an overload on the adjusting device a change of the adjusted position of the heel down-holding arrangement can occur. This device has an eccentric with two control surfaces which are offset in the axial direction, and the force transfer from the horizontal into the vertical is done through two inclined surfaces. Thus, the known device is complicated in its design and therefore susceptible to breakdown.

A purpose of the invention is to overcome the disadvantages of the known constructions and to provide a device corresponding to the initially mentioned type for facilitating longitudinal adjustment of ski binding parts, which device can be used in heel down-holding arrangements of any desired type of construction, is simple in its design, is inexpensive in its manufacture and reliable in operation, and furthermore can be operated with one hand, whereby as a tool only a conventional commercially available screwdriver is needed.

SUMMARY OF THE INVENTION

This purpose is attained inventively by providing a device of the above-mentioned type in which one leg of the locking member engages a downwardly projecting shoulder of the guide plate under the urging of a compression spring and the other leg, in the lifted position of the locking member, and thus when the locking teeth do not engage the serrated edges, is releasably lockable to the guide plate.

The inventive device is substantially simplified in its design as compared with known constructions. A basic difference in the inventive device, as compared with the device representing the state of the art, is that the locking member is swung by two compression springs toward the serrated edges of the guide rail, whereby the teeth on the web of the locking member engage the serrated edges and can be releasably held in engagement therewith. Should a breakdown occur in the region of the element which controls the locking member, then the locking member is swung automatically into its locked position. This means increased safety as compared with the known device, since in the downhill skiing position a safe locking of the device is desired, and not an unlocking which disrupts a secure holding of ski binding parts.

Of course, various possibilities are offered for releasably locking the leg in the lifted position of the locking member. Thus, it is possible according to a first inventive suggestion for releasably locking the leg to attach to such leg an outwardly pointing nose which, during lifting of the locking member, is guided through a recess in the guide plate. In this embodiment, the nose grips, in the locked position of the leg and under the urging of the helical spring, over the edge of the recess in the guide plate. Accordingly, no further springy element for the locking operation is needed. The device is therefore very simple. Of course, the locking force is predetermined.

Another inventive solution consists in an inwardly pointing nose being attached to the leg of the locking member for the releasable locking of the leg, and a springy wire which is cooperable with the nose being secured on the upper side of the guide plate. This solution has the advantage that the spring force of the wire which holds the leg of the locking member can be dimensioned to correspond with the desires or strength of the user, especially since the wire does not need to fulfill any further functions. It has proven advantageous in this design if the wire has an approximately rectangular design and has an interruption in the side thereof which does not face the nose of the locking member.

Fastening of the wire on the guide plate can be done in various ways. For example, the invention provides that the wire is secured on the guide plate by means of a sheet-metal strip which is riveted, welded or screwed to the guide plate. In order to thereby assure a reliable anchoring of the wire on the guide plate, according to a further characteristic of the invention, the sheet-metal strip is provided with a recess which corresponds in shape to a portion of the shape of the wire.

If one wants to do without such recess, then according to a different characteristic of the invention it is possible to support portions of the wire in recesses in the guide plate and to hold the wire on its upper side with a flat sheet-metal strip.

A further inventive solution involves the wire which has an approximately rectangular shape, being interrupted on the side which cooperates with the nose of the locking member, whereby the nose, viewed in a direction transverse of the ski, has a rectangular cross section, the longer dimension of which is slightly greater than the distance between the two free ends of the wire. In this exemplary embodiment, during lifting of the leg, its nose passes through the gap between the ends of the wire in order to subsequently rest on and be supported by such ends.

In order to stop an unintended unlocking of the locking member in this embodiment, the invention provides that the locking member has upward projections at a location between the locking teeth and the nose which, when the ski boot is inserted and has moved the guide plate rearwardly against the urging of the helical spring, prevent the locking teeth of the locking member from leaving the serrated edges of the guide rail.

It is actually not absolutely necessary that the wire be secured on the guide plate itself. Rather, according to a further embodiment of the invention, the leg of the locking member which is to be releasably held can carry at its free end an approximately semicircularly bent spring wire which lies, in the lifted position of the locking member, above the guide plate.

The swingable support of the locking member on the guide plate can occur in various ways. However, it has proven particularly advantageous if, in a further development of the invention, the leg of the locking member which leg is biased by the helical spring has lateral projections which are inserted in recesses provided on the guide plate, which recesses open toward the ski boot and extend generally parallel with respect to the guide plate at a location therebelow.

Another special development of the invention involves the ski binding part having a bearing block which is pivotal about a vertical axis and having a housing which is pivotal about a transverse axle arranged on the bearing block and which preferably carries a sole holder, by either the housing or the locking member having at least one inclined edge or surface, and by either the locking member or the housing having a counterpiece with an edge which extends longitudinally of the ski, which counterpiece, when the housing is swung up and the locking member is in its lifted position, cooperates with the edge or surface in response to a swinging out of the bearing block. Both the locking member and also the housing can each have at least one cooperating inclined surface. Through this particularly advantageous development, a tool is no longer needed for relocking the locking member after adjustment of the ski binding part to the sole of a particular boot has occurred. A slight swinging of the bearing block by hand is sufficient, which causes the locking member to be swung into its locked position against the guide rail due to the inclined edge or surface and the urging of the helical spring.

Another advantageous embodiment of the invention consists in providing on the housing or on the locking member two inclined edges or surfaces which are arranged symmetrically with respect to the longitudinal axis of the ski and are inclined toward one another in a direction away from the upper side of the ski. In this manner, a horizontal swinging of the bearing block selectively in either direction effects re-engagement of the locking member with the serrated edge.

A further characteristic of the invention involves the inclined surfaces which are provided on the locking member being arranged to extend generally parallel to the longitudinal axis of the ski. Through this, a relatively small height for the locking member is achieved and the space which is available is utilized optimally.

A further embodiment of the invention provides that the inclined surfaces on the housing extend at an acute angle with respect to the upper side of the ski. Through this measure, existing conditions are utilized optimally without expensive structural changes of the housing being needed.

In one embodiment of the invention, the housing is a sleevelike cover which receives a spring, which cover has in its area which faces the upper side of the ski a recess which is limited laterally on each side by a respective one of the inclined surfaces. Therefore, an arrangement of the inclined surfaces is possible without having to carry out any expensive structural changes of the binding part.

This is achieved inventively also when the sidewalls of the housing which carries the sole holder are provided with bent portions which point toward the longitudinal axis of the ski and are provided with the inclined edges or surfaces.

A further inventive solution involves the inclined surfaces being constructed on a locking part which is arranged or secured on the leg of the locking member which can be releasably held in the lifted position of the locking member. In this manner, the provided space is utilized optimally without expensive structural changes of a binding part being necessary.

A further advantage of the invention involves two guide surfaces, which extend transversely to the longitudinal axis of the ski and define an angle with respect to one another, being provided on the locking member, preferably in the region of the locking part of the locking member which faces the ski end, wherein one guide surface is, viewed from the upper side of the ski and the ski end, arranged at an acute angle with respect to the upper side of the ski and, during lifting of the locking member, is guided through a recess in the guide plate. In this manner, a secure holding of the locking member in its unlocked position is assured, so that the binding part can be moved without any problems into a desired position.

BRIEF DESCRIPTION OF THE DRAWINGS

Further characteristics, advantages and details of the invention will now be described in greater detail in connection with the drawings, which illustrate various exemplary embodiments.

DETAILED DESCRIPTION

Figure 1:
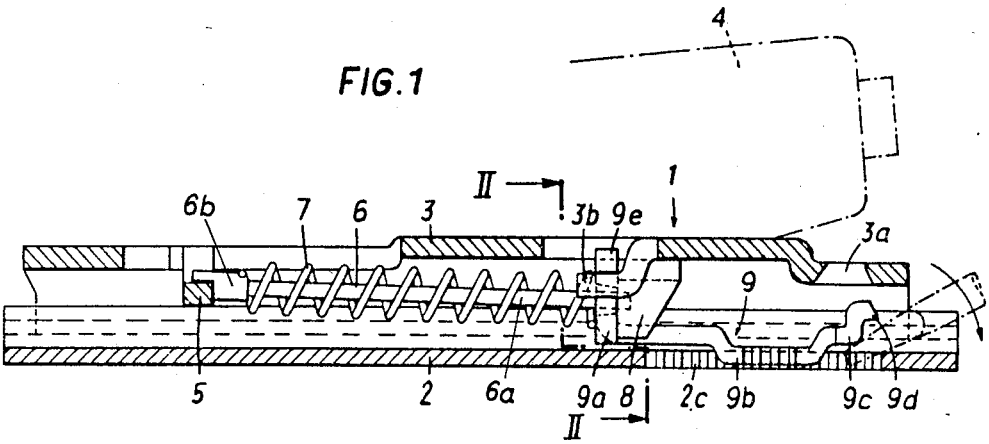
FIG. 1 is a sectional side view taken along the line I—I of FIG. 2 of a first embodiment of an adjusting device embodying the invention and showing a locking member thereof in a locked condition.
Figure 2:
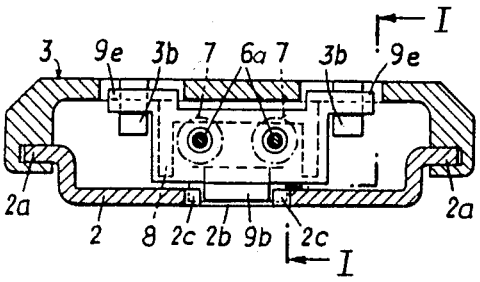
FIG. 2 is a sectional view taken along the line II—II of FIG. 1.
Figure 3:
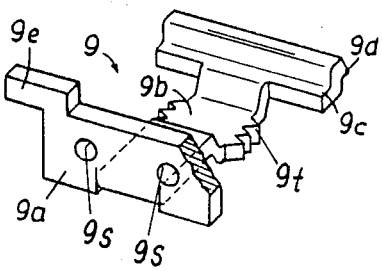
FIG. 3 is a perspective view of the locking member of FIG. 1.

A device for effecting the longitudinal adjustment of ski binding parts is illustrated in FIGS. 1–4 and is identified as a whole with reference numeral 1. It includes a guide rail 2 which can be secured on the ski, which has two laterally projecting guide bars 2*a*, and which has a central recess 2*b* which extends in its longitudinal direction. The latter has toothed or serrated edges 2*c* on opposite sides thereof.

A U-shaped guide plate 3 is movably supported on the guide rail 2 by means of grooves in the legs thereof which slidably receive the guide bars 2*a*, and a ski binding part is secured on the guide plate 3, for example a heel holder 4. A web 5 is punched out of and bent downwardly from the bight of the guide plate 3, and supports the bight or cross part 6*b* of a U-shaped guide element 6 which has two helical compression springs 7 encircling the parallel legs 6*a* thereof. Furthermore, the guide plate 3 has on its underside an approximately U-shaped shoulder 8 which is designed to engage one leg 9*a* of an approximately U-shaped locking member 9. The leg 9*a* is platelike and has two laterally spaced, frustoconical openings 9*s* therein, the legs 6*a* of the guide element 6 extending through these openings with a clearance. The leg 9*a* of the locking member 9 is pressed against the shoulder 8 by the urging of the two compression springs 7, but can swing within a certain range relative to the guide element 6. Furthermore, due to the mentioned clearance, movement of the legs 6*a* of the guide element 6 relative to the leg 9*a* is possible.

The web 9*b* of the locking member 9 carries teeth 9*t* on opposite sides thereof which are designated for engagement with the serrated edges 2*c* of the guide rail 2.

Figure 4:
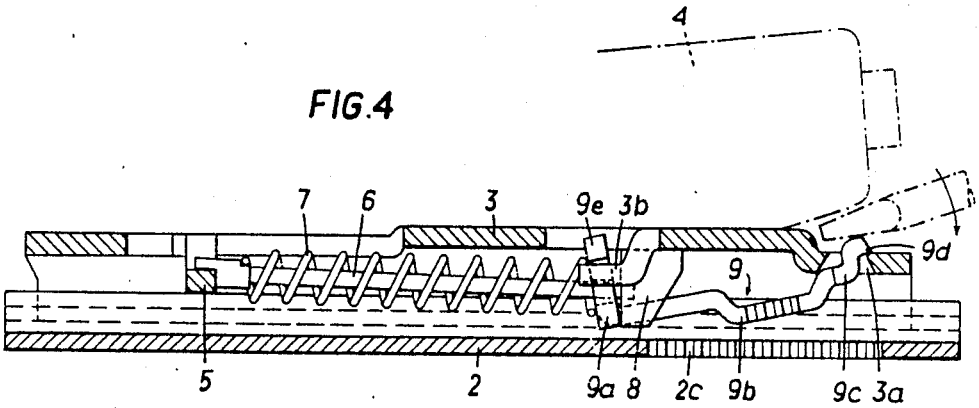
FIG. 4 is a view similar to FIG. 1 which shows the locking member in a lifted position.

The leg 9c of the locking member 9, which is remote from the leg 9a, is provided with an outwardly directed nose 9d which, following a lifting of the rear end of the locking member 9, extends through a recess or opening 3a provided in the guide plate 3 and lies, due to the urging of the compression springs 7, above the peripheral edge of the recess 3a in the guide plate 3 at the rear of the recess, as shown in FIG. 4.

For effecting the swingable support of the locking member 9 on the guide plate 3, the leg 9a thereof has two lateral projections 9e which extend transversely to the vertical longitudinal center plane of the ski and are supported in recesses defined by tabs 3b which are stamped from the material of the bight of the guide plate 3 and extend generally parallel thereto a small distance therebelow. The recesses 3b open in a direction toward the ski boot, so that the locking member 9 can easily be introduced into position during assembly.

Lifting of the rear end of the locking member 9 can be done by means of a screwdriver, the blade of which is introduced between a shoulder of the leg 9c and the guide rail 2, as shown in FIG. 1. When a desired position of the guide plate 3 relative to the guide rail 2 is achieved, then the blade of the screwdriver is introduced into the gap between the ski binding part 4 and the guide plate 3, as shown in FIG. 4, and the nose 9b of the locking member 9 is pressed downwardly through the recess 3a in the guide plate. Since the locking member 9 is urged by the two compression springs 7 to pivot downwardly toward the guide rail 2, the teeth 9t on the web 9b of the locking member 9 are moved into engagement with the serrated edges 2c on the guide rail 2.

In other words, when the locking member 9 is in the lifted position shown in FIG. 4, the guide plate 3 and locking member 9 can be freely moved relative to the guide rail 2 in a direction longitudinally thereof. When the guide plate 3 has been placed in a desired position, the locking member is returned to the locked position of FIG. 1, in which the teeth 9t thereof engage the serrated edges 2c of the guide rail 2 and secure the locking member 9 against movement relative to the guide rail 2. The guide plate 3 can thereafter move rightwardly in FIG. 1 relative to the locking member 9 and guide rail 2 against the urging of the springs 7, the legs 6a of guide element 6 sliding within the openings 9s in the locking member 9, so that the bight 6b of the guide element 6 moves toward the leg 9a of the locking member 9 and compresses the springs 7. Leftward movement of the guide plate 3 relative to the locking member 9 and guide rail 2 in FIG. 1 under the urging of the springs 7 is limited by engagement of the projections 9e with the shoulder 8.

Figure 5:
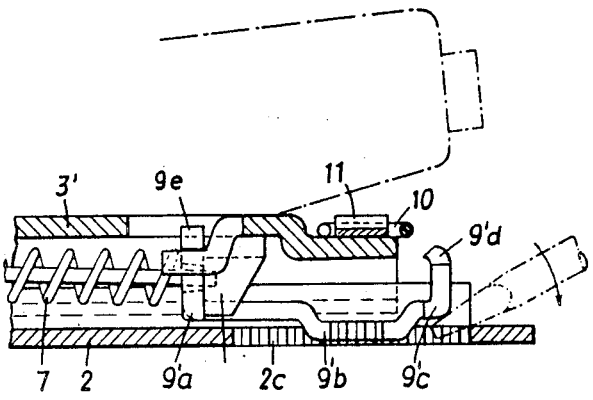
FIG. 5 is a fragmentary sectional side view of an alternative embodiment of the device of FIG. 1.
Figure 6:
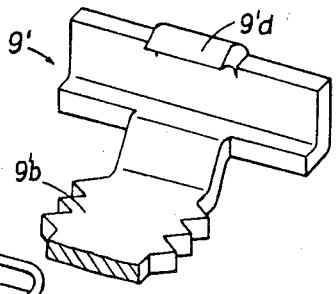
FIG. 6 is a fragmentary perspective view of the locking member for the device of FIG. 5.

The exemplary embodiment according to FIGS. 5 and 6 differs from that described above, mainly in that the nose 9'd at the rear end of the locking member 9' is directed forwardly or inwardly and, during lifting of the rear end of the locking member 9', moves into engagement with a springy wire 10 which is secured on the upper side of the guide plate 3'. The wire 10 has approximately the shape of a rectangle, and has an interruption in the side opposite that which engages the nose 9'd. The wire 10 is held by a sheet-metal strip 11 which is preferably riveted or screwed to the upper side of the guide plate 3'. In order to assure a secure support of the wire 10, the sheet-metal strip 11 is provided with an impression which corresponds to the shape of a portion of the wire 10.

Figure 7:
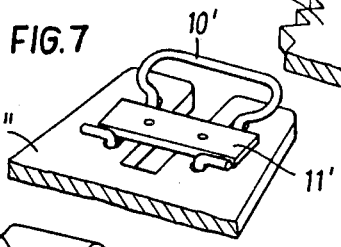
FIG. 7 is a fragmentary perspective view of a modification of the device of FIG. 5.

However, there exists also the possibility to provide a wire 10' (FIG. 7) having portions which lie in recesses provided in the guide plate 3''. In this case, a flat sheet-metal strip 11' can be used, as shown in FIG. 7.

Figure 8:
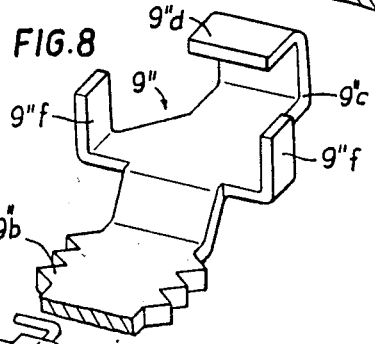
FIGS. 8 and 9 are perspective views similar to FIGS. 6 and 7, respectively, of a locking member from a further embodiment of the device of FIG. 1.
Figure 9:
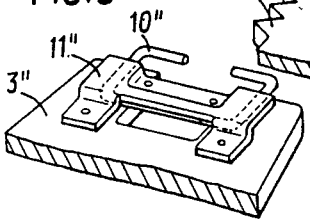

A further embodiment (FIGS. 8 and 9) is distinguished by a wire 10'' which has approximately a rectangular shape and is interrupted in the side thereof which cooperates with the nose 9''d of the locking member 9'', and the nose 9''d is a plate of rectangular cross section having a width which is slightly greater than the distance between the two ends of the wire 10''.

The ends of the wire 10'' initially lie above the nose 9''d. When the locking member 9'' is lifted by means of a screwdriver, then the two ends of the wire 10'' are flexed upwardly by the nose 9''d and slide on the narrow side edges of the nose 9''d until they are below the nose 9''d and spring back into the position in which they are parallel to the upper side of the ski, but they are now below nose 9''d. Through this, the locking member 9' is held in the lifted position by engagement of the ends of wire 10'' with the underside of nose 9''d.

When the teeth 9t of the locking member 9'' are again supposed to engage the serrated edges 2c of the guide rail 2, then the nose 9''d is simply pressed downwardly by means of a screwdriver, whereby the two ends of the wire 10'' are flexed downwardly and slide along the narrow sides of the nose 9''d until the nose 9''d is below them and they can spring back into their original position.

In this embodiment, two laterally spaced shoulders 9''f project upwardly from the locking member 9'' between the nose 9''d and web 9''b thereof. These serve to prevent disengagement of the teeth of the locking member 9'' from the serrated slats 2c of the guide rail 2 when the ski boot is inserted into the heel downholding means 4, because the guide plate 3'' is moved slightly rearwardly against the force of the compression springs 7 and is then disposed above the tops of the shoulders 9''f, thereby preventing upward movement of the locking member 9''. Also in this exemplary embodiment, the fastening of the wire 10'' occurs through a sheet-metal strip 11'' which is provided with an impression that corresponds with the shape of a portion of the wire 10'' and which is secured or riveted on the upper side of the guide plate 3'' (see FIG. 9).

Figure 10:
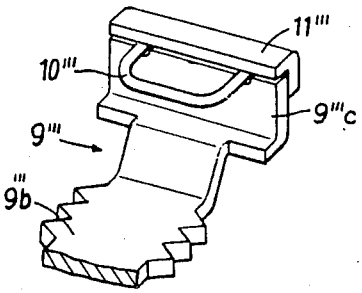
FIG. 10 is a perspective view similar to FIG. 6 of yet another embodiment.

Of course, it is not absolutely necessary that the springy wire be secured on the guide plate 3'''. Rather, it is possible, as illustrated in FIG. 10, to secure the springy wire 10''' on the locking member 9''' so that, in the lifted position of the locking member 9''', the wire 10''' is disposed above a portion of the guide plate 3'''. In this case, for fastening the wire 10''' in position, a sheet-metal strip 11''' of L-shaped cross section is provided which is secured at the end of the leg 9'''c of the locking member 9'''. The wire 10''' is a rectangle having strongly curved corners, and can in a sense be considered to be approximately semicircular. In this exemplary embodiment, the lifting and the pressing down of the locking member 9''' is again preferably effected by means of a screwdriver.

Figure 11:
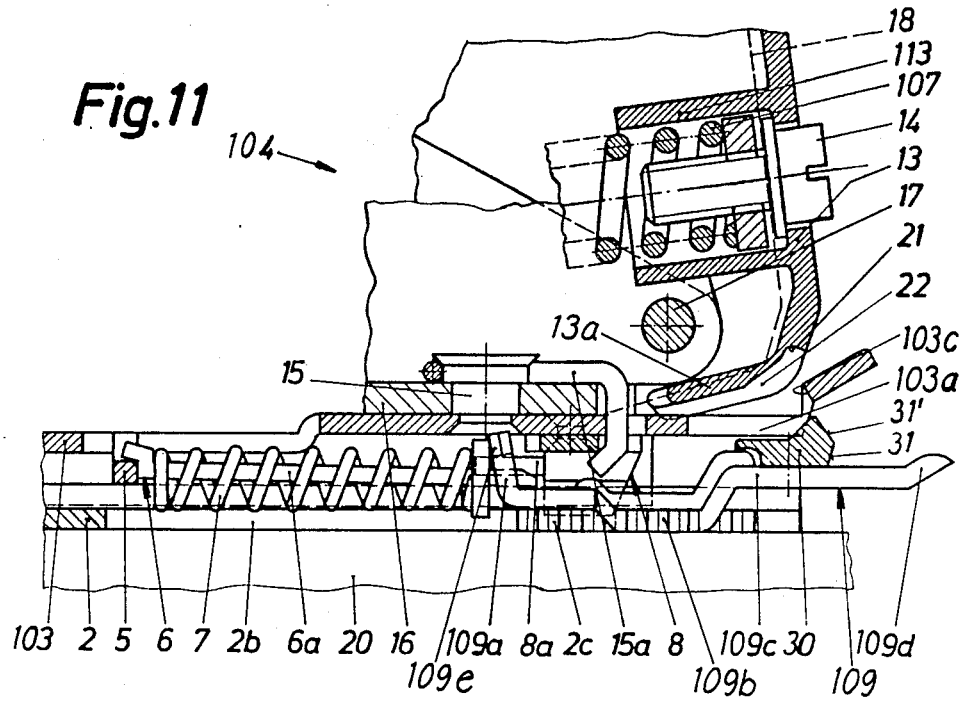
FIG. 11 is a view similar to FIG. 1 of another alternative embodiment of the adjusting device with the locking member in a locked position and a binding part having a sole holder which is in a closed position.
Figure 12:
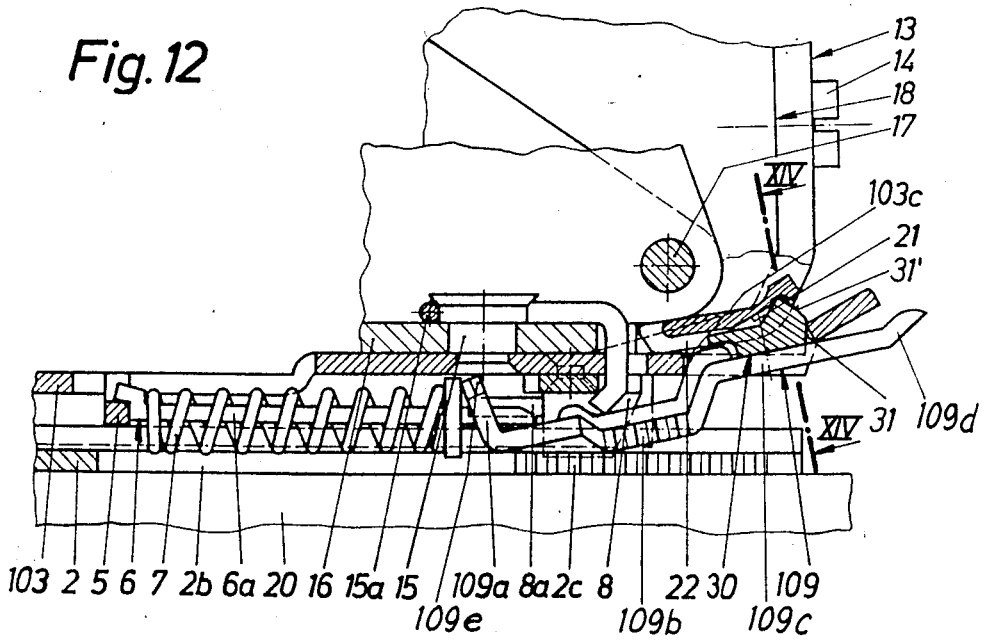
FIG. 12 is a view similar to FIG. 11 of the device of FIG. 11, showing the locking member in an unlocked position and the sole holder in an open position.

Another exemplary embodiment of the invention is illustrated in FIG. 11, in which a guide rail 2 is secured on a ski 20 and is provided centrally with a recess 2b which extends longitudinally. The latter has on both sides a toothed or serrated edge 2c. A guide plate 103 is movably supported on the guide rail 2, on which guide plate 103 is arranged a ski binding part 104 which is a heel holder. The ski binding part 104 has a bearing block 16 which can be pivoted about a vertical axle 15 which is constructed as a swivel pin and is riveted in the guide plate 103. A housing 18 is supported for pivotal movement about an axle 17 which extends transversely with respect to the longitudinal direction of the ski and is supported on the bearing block 16, which housing 18 carries a conventional sole holder which can hold down the heel of a ski boot and which is not illustrated. Furthermore, a return spring 15*a* is provided which is wound around a swivel pin which forms the vertical axle 15 and the ends of which are supported on the guide plate 103. The bearing block 16 can be swung out laterally or diagonally together with the housing 18 and the sole holder against the force of a release spring which is not illustrated. Since this structure is known, it is not discussed in greater detail. (See U.S. Pat. No. 3,876.219).

According to the invention, many of the structural parts in FIG. 11 correspond generally in structure with the corresponding structural parts in the embodiment of FIGS. 1 to 4. Therefore, only significant differences are described.

In the embodiment of FIG. 11, the locking member 109 carries a locking part 30 which is secured on the leg 109*d* thereof, for example, by rivets. At its end which is remote from the guide element 6, the locking part 30 of the locking member 109 is provided with two guide surfaces 31 and 31' which extend transversely to the longitudinal axis of the ski, are adjacent one another, and define an angle with respect to one another. The guide surface 31, which is closer to the upper side of the ski, is arranged at an acute angle with respect to the longitudinal axis of the ski in the locked position of the locking member 109 and the second guide surface 31' defines, in the same position of the locking member 109, an obtuse angle with respect to the longitudinal axis of the ski. Furthermore, two surfaces 12 (FIG. 14) are arranged on the locking part 30 symmetrically with respect to the longitudinal axis of the ski, extend inclined to one another at an angle with respect to the upper side of the ski, and converge in a direction upwardly away from the upper side of the ski.

Figure 14:
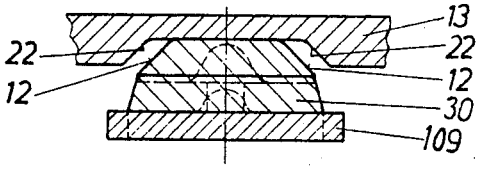
FIG. 14 is a fragmentary sectional view taken along the line XIV—XIV of FIG. 12.
Figure 15:
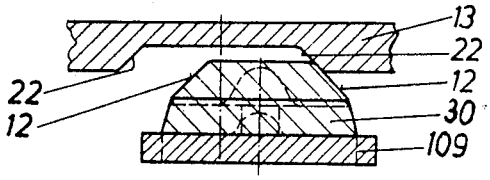
FIG. 15 is a view similar to FIG. 14 but showing a different position of operation.

Between the two sidewalls of the housing 18 which carries the sole holder, a further housing is provided which is preferably an approximately sleeve-shaped cover 13 constructed as a spring housing 113 and receives a spring 107. The cover 13 pivots upwardly about the axle 17 together with the housing 18 which carries the sole holder during a release operation. The spring 107, spring housing 113 and cover 13 are known and are not the subject matter of the present invention. From the cover 13 projects the head of an adjusting screw 14, by means of which the initial tension of the spring can be adjusted in a conventional manner. According to the invention, a wall portion 13*a* of the cover 13 faces the upper side of the ski and extends toward the upper side of the ski at an angle thereto. The portion 13*a* of the cover 13 is provided with a recess 21, which is limited laterally by respective inclined surfaces 22 (FIG. 14). The two inclined surfaces 22 are arranged symmetrically with respect to the longitudinal axis of the ski, diverge away from the bottom surface of the recess 21, and are each arranged at an acute angle with respect to the upper side of the ski. The inclination of the surfaces 22 relative to the bottom of the recess 21 preferably corresponds approximately to the inclination of the inclined surfaces 12 of the locking part 30 of the locking member 109 relative to the upper side of the ski.

Lifting of the locking member 109 to permit adjustment of the ski binding part 104 to different ski boot lengths is done by means of a screwdriver, the blade of which is introduced between the leg 109*c* and the guide rail 2. During lifting of the locking member 109 the inclined surface 31' of the locking part 30 slides along an inclined surface 103*c* on the guide plate 103 which defines in part a recess 103*a* in the guide plate 103, whereby the compression springs 7 are slightly compressed. A position of the locking member 109 in which it is secured against an unintended return is reached when, after a certain lifting movement of the locking member 109, the inclined surface 31 slides onto surface 103*c*, which permits the compression springs 7 to relax slightly, and thus has a toggle effect.

To adjust the binding to the length of a particular ski boot, the sole holder is swung in a conventional manner by means of a release lever, not illustrated, into its open position. Through this, the cover 13 also swings up. The tip area of the ski boot is then introduced into the front jaw, which is not illustrated.

The ski binding part 104 and guide plate 103 are now moved forwardly or backwardly on the guide rail 2 until the sole holder is spaced a small distance from the heel of the ski boot and the desired position of the guide plate 103 is thus reached.

When the locking member 109 was lifted and the sole holder opened, the locking part 30 entered the recess 21 of the cover 13 and is thus disposed between the two inclined surfaces 22, as shown in FIG. 14. Therefore, if the ski binding part 4 which is being manually gripped is pivoted slightly about its vertical axle 15 against the small force of the return spring 15*a*, then one of the inclined surfaces 22 of the cover 13 will engage an inclined surface 12 of the locking part 30 on the locking member 109, which causes the locking member 109 to be swung downwardly toward the guide rail 2 and the teeth on the web 109*b* of the locking member 109 to engage, under the urging of the two compression springs 7, the serrated edges 2*c* of the guide rail 2. Therefore, a tool such as a screwdriver is no longer needed for fixing the ski binding part 104 in the desired position.

Of course, it is also possible to effect the locking by pressing downwardly on the nose 109*d* with a finger or a screwdriver in a direction toward the guide rail 2. However, for this a greater amount of force is needed than for the above-described pivoting of the binding part 4.

Furthermore, it is conceivable to introduce the blade of the screwdriver into the gap between the cover 13 and the locking part 30 of the locking member 109 and to press the locking member 109 downwardly through the recess 103*a* of the guide plate 103.

Figure 11A:
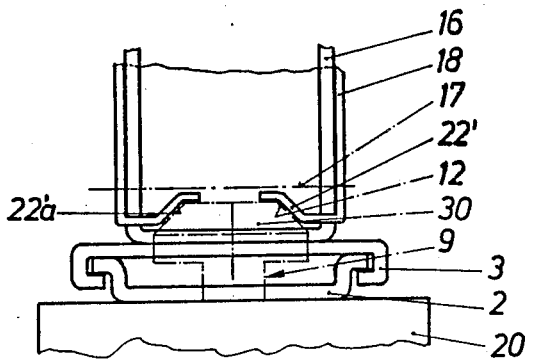
FIG. 11*a* is a back view of a further alternative embodiment of the adjusting device.
Figure 13:
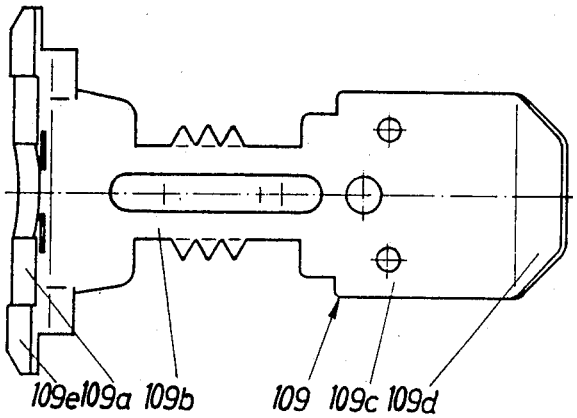
FIG. 13 is a top view of the locking member of the device of FIG. 11.

An alternative embodiment of the invention is illustrated in FIG. 11*a*. According to this embodiment the inclined surfaces 22'*a* which cooperate with the locking part 9 are constructed on the upward swingable housing 18 itself. For this purpose the two sidewalls of the housing 18 are provided in a corresponding manner with bent portions 22' which point in the direction of the longitudinal axis of the ski, which portions have the inclined surfaces 22'*a* thereon. The further structural parts and the adjusting movement correspond generally to the embodiment of FIG. 11.

The invention is not limited to the illustrated exemplary embodiments. Variations or modifications thereof, including the rearrangement of parts, are possible without leaving the scope of the invention. For example, devices in which the U-shaped shoulder on the underside of the guide plate and the sheet-metal strip are integral or in which, instead of a springy wire, a leaf spring is utilized for locking the locking member in the lifted position fall within the invention. It is also possible to provide on the locking member or on the housing inclined edges and to construct on the counterpiece (the locking member or housing) either inclined surfaces or edges which extend longitudinally of the ski. Also, the inclination of the inclined surfaces or edges relative to the upper side of the ski and also to one another can be varied and chosen within a certain range.

The embodiments of the invention in which an exclusive property or privilege is claimed are defined as follows:

1. A ski binding apparatus adapted to releasably hold a ski boot on a ski, comprising: a guide rail adapted to be fixedly mounted on the ski and having thereon a row of teeth which extends in a direction longitudinally of the ski; a guide member supported on said guide rail for longitudinal movement therealong, said guide member being adapted to have a ski binding part mounted thereon; a locking member which has a tooth thereon; means supporting said locking member and said guide member for relative longitudinal movement, and means supporting said locking member for movement in directions which effect movement of said tooth generally transversely of said longitudinal direction between first and second positions in which said tooth is respectively engaging and spaced from said row of teeth on said guide rail; resilient means for yieldably urging longitudinal movement of said locking member relative to said guide plate; limit means for limiting longitudinal movement of said locking member under the urging of said resilient means; and holding means cooperable with said locking member when it is in said second position for releasably holding said locking member against movement toward said first position, said holding means including a resilient element which is supported on one of said guide plate and said locking member and is cooperable with a nose provided on the other of said guide plate and said locking member; wherein said locking member moves generally vertically between said first and second positions, said second position being above said first position; wherein said locking member has an upward projection thereon; and wherein when said guide member has been moved a predetermined distance relative to said locking member against the urging of said resilient means, said projection is disposed beneath and has its upper end adjacent an underside of said guide member, thereby preventing upward movement of said locking member away from said first position.

2. A device for adjusting the longitudinal position of a ski binding part on a ski, comprising a guide rail which can be secured on a ski, which has two lateral guide bars and which has two serrated edges arranged between said guide bars and extending in the longitudinal direction of the device, with which edges is associated a locking member biased by an end of a compression spring which has its other end supported on a guide plate which is movably supported on said guide rail, wherein said locking member, viewed from the side, has approximately an upwardly open U-shaped design and includes two legs connected by a web having locking teeth thereon, wherein one of said legs of said locking member engages a downwardly projecting shoulder of said guide plate under the urging of said compression spring and the other of said legs, in a lifted position of said locking member in which said locking teeth do not engage said serrated edges, can be releasably held by said guide plate, wherein for releasably holding said other leg, a nose which points outwardly is attached to said other leg and said guide plate has therethrough an opening having a periphery defined by an edge on said guide plate, wherein said nose is spaced from said opening when said locking member is in a locking position in which said teeth thereon are engaging said serated edges, wherein said nose, during lifting of said locking member from said locking position to said lifted position, moves through said opening provided in said guide plate, and wherein in said lifted position said nose engages over said edge on said guide plate to releasably hold said locking member in its lifted position.

3. A device for adjusting the longitudinal position of a ski binding part on a ski, comprising a guide rail which can be secured on a ski, which has two lateral guide bars and which has two serrated edges arranged between said guide bars and extending in the longitudinal direction of the device, with which edges is associated a locking member biased by an end of a compression spring which has its other end supported on a guide plate which is movably supported on said guide rail, and wherein said locking member, viewed from the side, has approximately an upwardly open U-shaped design and includes two legs connected by a web having locking teeth thereon, wherein one of said legs of said locking member engages a downwardly shoulder of said guide plate under the urging of said compression spring and the other of said legs, in a lifted position of said locking member in which said locking teeth do not engage said serrated edges, can be releasably held by said guide plate, wherein for releasably holding said other leg of said locking member, an inwardly pointing nose is attached to said other leg, and wherein on the upper side of said guide plate there is secured a springy wire which is cooperable with said nose to releasably hold said locking member in its lifted position.

4. The device according to claim 3, wherein said wire has a generally rectangular shape and has an interruption in a side thereof which does not cooperate with said nose.

5. The device according to claim 3, wherein said wire is secured on said guide plate by a sheet-metal strip which is riveted, welded or screwed to said guide plate.

6. The device according to claim 5, wherein said sheet-metal strip is provided with a recess which receives a portion of said wire.

7. The device according to claim 5, wherein said wire has portions which are disposed in recesses provided in said guide plate and wherein said sheet-metal strip which holds said wire on the upper side of said guide plate is flat.

8. The device according to claim 3, wherein said wire has an approximately rectangular shape and is interrupted on the side thereof which cooperates with said nose of said locking member so as to define two spaced ends, and wherein said nose, viewed in the longitudinal direction of the ski, has a generally rectangular cross section, the longer dimension of which is slightly greater than the distance between said two ends of said wire.

9. The device according to claim 8, wherein said locking member has projections which project upwardly at a location between said locking teeth and said nose and, when a ski boot has been inserted into said ski binding part and has moved said guide plate rearwardly against the urging of said compression spring, can engage said guide plate to prevent movement of said locking member which would cause disengagement of said locking teeth of said locking member from said serrated edges of said guide rail.

10. A device for adjusting the longitudinal position of a ski binding part on a ski, comprising a guide rail which can be secured on a ski, which has two lateral guide bars and which has two serrated edges arranged between said guide bars and extending in the longitudinal direction of the device, with which edges is associated a locking member biased by an end of a compression spring which has its other end supported on a guide plate which is movably supported on said guide rail, and wherein said locking member, viewed from the side, has approximately an upwardly open U-shaped design and includes two legs connected by a web having locking teeth thereon, wherein one of said legs of said locking member engages a downwardly projecting shoulder of said guide plate under the urging of said compression spring and the other of said legs, in a lifted position of said locking member in which said locking teeth do not engage said serrated edges, can be releasably held by said guide plate, wherein said other leg of said locking member supports at its free end an approximately semicircular bent spring which, in the lifted position of said locking member, lies above said guide plate.

11. A device for adjusting the longitudinal position of a ski binding part on a ski, comprising a guide rail which can be secured on a ski, which has two lateral guide bars and which has two serrated edges arranged between said guide bars and extending in the longitudinal direction of the device, with which edges is associated a locking member biased by an end of a compression spring which has its other end supported on a guide plate which is movably supported on said guide rail, and wherein said locking member, viewed from the side, has approximately an upwardly open U-shaped design and includes two connected by a web having locking teeth thereon, wherein one of said legs of said locking member engages a downwardly projecting shoulder of said guide plate under the urging of said compression spring and the other of said legs, in a lifted position of said locking member in which said locking teeth do not engage said serrated edges, can be releasably held by said guide plate, wherein said one leg of said locking member which is biased by said compression spring has lateral projections which are received in recesses in said guide plate, and wherein said recesses open toward the ski boot and are defined by tabs which extend parallel to said guide plate at a distance below it.

12. A device for adjusting the longitudinal position of a ski binding part on a ski, comprising a guide rail which can be secured on a ski, which has two lateral guide bars and which has two serrated edges arranged between said guide bars and extending in the longitudinal direction of the device, with which edges is associated a locking member biased by an end of a compression spring which has its other end supported on a guide plate which is movably supported on said guide rail, and wherein said locking member, viewed from the side, has approximately an upwardly open U-shaped design and includes two legs connected by a web having locking teeth thereon, wherein one of said legs of said locking member engages a downwardly projecting shoulder of said guide plate under the urging of said compression spring and the other of said legs, in a lifted position of said locking member in which said locking teeth do not engage said serrated edges, can be releasably held by said guide plate, wherein said ski binding part has a bearing block which can be pivoted about a vertical axis and has a housing which is pivotal about a transverse axle arranged on said bearing block and carries a sole holder, wherein one of said housing and said locking member has at least one inclined surface, and wherein the other of said locking member and said housing has a counterpiece with an edge which extends longitudinally of the ski, which counterpiece, when said housing is in a raised position and said locking member is in the lifted position, and in response to pivotal movement of said bearing block, cooperates with said inclined surface to effect movement of said locking member back toward the position in which said locking teeth engage said serrated edges.

13. The device according to claim 12, wherein two of said inclined surfaces are provided on said one of said housing and said locking member, said inclined surfaces being arranged symmetrically with respect to the longitudinal axis of the ski and being inclined toward one another in a direction away from the upper side of the ski.

14. The device according to claim 12, wherein two of said inclined surfaces are provided on said locking member and extend parallel to the longitudinal axis of the ski.

15. The device according to claim 12, wherein two of said inclined surfaces are provided on said housing and extend at an acute angle with respect to the upper side of the ski.

16. The device according to claim 12, wherein said housing is a cover which is sleevelike and receives a spring, which has two said inclined surfaces thereon, and which has a recess in a region which faces the upper side of the ski, said recess being bounded laterally by said inclined surfaces.

17. The device according to claim 12, wherein two of said inclined surfaces are provided on said housing, and wherein sidewalls of said housing carry said sole holder and have bent portions which each point in a direction toward the longitudinal axis of the ski, said bent portions each having thereon a respective one of said inclined surfaces.

18. The device according to claim 12, wherein two of said inclined surfaces are provided on a locking part which is secured on said other leg of said locking member.

19. The device according to claim 18, wherein said locking member has two guide surfaces which extend transversely to the longitudinal axis of the ski and define an angle with one another, wherein a first said guide surface defines an acute angle with respect to a portion of the upper side of the ski located between said device and a rear end of the ski, wherein said second guide surface, which is adjacent said first guide surface, defines an obtuse angle with respect to said portion of the upper side of the ski, and wherein, during lifting of said locking member, said guide surfaces move into a recess provided in said guide plate.

20. A ski binding apparatus adapted to releasably hold a ski boot on a ski, comprising: a guide rail adapted to be fixedly mounted on the ski and having thereon a row of teeth which extends in a direction longitudinally of the ski; a guide member supported on said guide rail for longitudinal movement therealong, said guide member being adapted to have a ski binding part mounted thereon; a locking member which has a tooth thereon; means supporting said locking member and said guide member for relative longitudinal movement, and means supporting said locking member for movement in directions which effect movement of said tooth generally transversely of said longitudinal direction between first and second positions in which said tooth is respectively engaging and spaced from said row of teeth on said guide rail; resilient means for yieldably urging longitudinal movement of said locking member relative to said guide plate; limit means for limiting longitudinal movement of said locking member under the urging of said resilient means; and holding means integral to said binding apparatus and cooperable with said locking member when it is in said second position for releasably holding said locking member against movement toward said first position, said holding means including a resilient locking element which is provided on and resiliently deformable relative to one of said guide plate and said locking member and is cooperable with a nose provided on the other of said guide plate and said locking member, wherein as said locking member moves from one of its first and second positions to the other thereof, said locking part is engaged by and resiliently deformed by said nose as said nose moves therepast, and then resiliently resumes its original shape.

21. The apparatus according to claim 20, wherein said resilient locking element is a piece of spring wire which is flexed as said nose is engaged and disengaged therewith.

22. A ski binding apparatus adapted to releasably hold a ski boot on a ski, comprising: a guide rail adapted to be fixedly mounted on the ski and having thereon a row of teeth which extends in a direction longitudinally of the ski; a guide member supported on said guide rail for longitudinal movement therealong, said guide member having a ski binding part mounted thereon and said ski binding part including a binding member which is supported for pivotal movement about a generally vertical axis relative to said guide member; a locking member which has a tooth thereon; means supporting said locking member and said guide member for relative longitudinal movement, and means supporting said locking member for generally vertical movement which effects movement of said tooth between first and second positions in which said tooth is respectively engaging and spaced from said row of teeth on said guide rail, said second position being above said first position; resilient means for yieldably urging longitudinal movement of said locking member relative to said guide plate; limit means for limiting longitudinal movement of said locking member under the urging of said resilient means; holding means cooperable with said locking member when it is in said second position for releasably holding said locking member against movement toward said first position; and release means responsive to pivotal movement of said binding member of said ski binding part for causing said locking member to be released from said holding means and to move from said second position toward said first position.

23. The apparatus according to claim 22, wherein said release means includes said binding member having two laterally spaced, inwardly facing, upwardly converging surfaces thereon, rotation of said binding member about said vertical axis when said locking member is in said second position causing one of said surfaces to engage said locking member and urge it downwardly toward said first position.

* * * * *

UNITED STATES PATENT AND TRADEMARK OFFICE

CERTIFICATE OF CORRECTION

PATENT NO. : 4 699 398

DATED : October 13, 1987

INVENTOR(S) : Franz Luschnig et al

It is certified that error appears in the above-identified patent and that said Letters Patent is hereby corrected as shown below:

Column 12, line 31; after "downwardly" insert ---projecting---.

Column 13, line 41; after "two" insert ---legs---.

Signed and Sealed this

Seventeenth Day of May, 1988

*Attest:*

*Attesting Officer*

DONALD J. QUIGG

*Commissioner of Patents and Trademarks*